US010056711B1

(12) United States Patent
Zhu

(10) Patent No.: US 10,056,711 B1
(45) Date of Patent: Aug. 21, 2018

(54) DUSTPROOF SOCKET CAPABLE OF STABILIZING PLUG

(71) Applicant: Ziyu Zhu, Guangzhou (CN)

(72) Inventor: Ziyu Zhu, Guangzhou (CN)

( * ) Notice: Subject to any disclaimer, the term of this patent is extended or adjusted under 35 U.S.C. 154(b) by 0 days.

(21) Appl. No.: 15/973,758

(22) Filed: May 8, 2018

(30) Foreign Application Priority Data

Apr. 23, 2018 (CN) ..... 2018 1 0367308

(51) Int. Cl.
*H01R 13/44* (2006.01)
*H01R 13/52* (2006.01)
*H01R 13/639* (2006.01)
*H01R 13/453* (2006.01)

(52) U.S. Cl.
CPC ..... *H01R 13/5213* (2013.01); *H01R 13/4534* (2013.01); *H01R 13/6395* (2013.01)

(58) Field of Classification Search
CPC H01R 13/447; H01R 13/4534; H01R 13/453; H01R 13/4538; H01R 13/5213
See application file for complete search history.

(56) References Cited

U.S. PATENT DOCUMENTS 5,702,259 A * 12/1997 Lee ..... H01R 13/4534 439/137
6,786,745 B1 * 9/2004 Huang ..... H01R 13/4534 439/137
2006/0270254 A1 * 11/2006 Chiang ..... H01R 13/4538 439/137
2012/0083143 A1 * 4/2012 Jiang ..... H01R 13/4534 439/137
2017/0085022 A1 * 3/2017 Zhang ..... H01R 13/4534
2017/0187138 A1 * 6/2017 Lin ..... H01R 13/4534

* cited by examiner

*Primary Examiner* — Xuong Chung Trans

(57) ABSTRACT

A dustproof socket capable of stabilizing a plug of the present invention comprising a socket body, wherein a mounting cover is fixed on the socket body, and an opening is formed in the mounting cover; the two ends of the inner side of the opening are respectively provided with a sliding groove, and a baffle plate is slidably mounted in each sliding groove; when the baffle plate retracts into the sliding groove, the opening is opened, and when the baffle plate stretches out from the sliding groove, the opening is closed; an elastic reset mechanism is connected between the baffle plate and the mounting cover; the elastic reset mechanism is used for forcing the baffle plate to keep in a state of stretching out from the sliding groove.

7 Claims, 2 Drawing Sheets

DUSTPROOF SOCKET CAPABLE OF STABILIZING PLUG

TECHNICAL FIELD OF THE INVENTION

The present invention relates to the technical field of plug sockets, and more particularly, to a dustproof socket capable of stabilizing a plug.

BACKGROUND OF THE INVENTION

With the rapid development of science and technology, various electric appliances have become more prominent into people's daily life. An electric appliance is supplied with power when connected to a socket via a plug. In the prior art, the jacks of the traditional socket are directly exposed so that dust can easily enter into the socket. Even worse, the dust attached to the wires and components can severely damage the socket after prolonged use. Furthermore, it's difficult to stabilize a traditional plug in the socket. When being pulled, the plug can suddenly separate from the socket, causing a short circuit or sudden disconnection during the operation of the electric appliance. As a result, the electrical lifespan can be sharply shortened.

In conclusion, the shortcomings of the traditional sockets are urgent problems that need to be solved for those skilled in this field.

SUMMARY OF THE INVENTION

The purpose of the present invention is to solve the shortcomings in the prior art by providing a dustproof socket capable of stabilizing a plug, which can prevent the dust from entering into the socket while protecting the plug from being suddenly separated from the socket.

To achieve the above purpose, the present invention adopts the following technical solution:

A dustproof socket capable of stabilizing a plug of the present invention comprises a socket body, wherein a mounting cover is fixed on the socket body, and an opening is formed in the mounting cover. The two ends of the inner side of the opening are respectively provided with a sliding groove, and a baffle plate is slidably mounted in each sliding groove. When the baffle plate retracts into the sliding groove, the opening is opened, and when the baffle plate stretches out from the sliding groove, the opening is closed.

In another aspect of the present invention, an elastic reset mechanism is connected between the baffle plate and the mounting cover. The elastic reset mechanism is used for forcing the baffle plate to keep in a state of stretching out of the sliding groove.

In another aspect of the present invention, a notch is formed in the outer end surface of the baffle plate, a mounting groove is formed in the notch, and a stop block is slidably disposed in the mounting groove. An elastic reset device is connected between the stop block and the inner bottom of the mounting groove, and the elastic reset device is used for forcing the stop block to keep in a state of stretching out of the mounting groove.

In another aspect of the present invention, the elastic reset mechanism comprises a reset rod, a movable block, a connecting shaft and an elastic element. The inner surfaces of the two sides of the mounting cover are respectively provided with a fixing groove. The connecting shaft is fixed in the fixing groove, and the movable block is slidably sleeved with the connecting shaft. The elastic element that is sleeved on the connecting shaft is connected to the bottom end of the movable block and the fixing groove. The two ends of the reset rod are respectively rotationally hinged to the baffle plate and the movable block.

In another aspect of the present invention, the elastic reset device comprises a fixing rod and an elastic body. One end of the fixing rod is fixed at the bottom end of the mounting groove, and the other end of the fixing rod is provided with a connecting cap. The stop block is provided with a connecting groove, and a baffle ring is disposed at the opening of the connecting groove. The connecting cap is slidably inserted into the connecting groove. The elastic body is sleeved on the fixing rod, and is connected to the bottom of the stop block and the mounting groove.

In another aspect of the present invention, an operating rod is connected to the baffle plate, and a slide opening is formed in the outer surface of the mounting cover. The operating rod is slidably located in the slide opening.

In another aspect of the present invention, an accommodating groove is formed in the mounting cover and is close to the slide opening. The accommodating groove and the slide groove are arranged in parallel. A movable plate is slidably disposed in the accommodating groove, and one side of the movable plate is connected to the operating rod. When the movable plate is aligned with the slide opening, the slide opening is sealed.

In another aspect of the present invention, a limiting block is disposed on the outer surface of the mounting cover, and an operating cap is rotationally connected with the end portion of the operating rod. The operating cap possesses a first position and a second position during the rotating process. When the operating cap is in the first position, it can be limited by the limiting blocks, and when the operating cap is in the second position, it can pass the gap between the two limiting blocks.

In another aspect of the present invention, there're two limiting blocks that are arranged in parallel. When the operating cap is in the first position, the operating cap is prevented from passing through a gap between the two limiting blocks. When the operating cap is in the second position, it can pass the gap between the two limiting blocks.

Compared with the prior art, the present invention has the following advantages:

Due to the existence of the opening formed in the mounting cover of the socket body, dust easily enters the interior of the socket body, causing damage to the internal structure and the electric components of the socket body. Therefore, a baffle plate having a retractable structure is additionally disposed at the opening of the mounting cover. When the baffle plate retracts into the sliding groove, the opening is opened for allowing the plug to enter, and when the plug is completely inserted into the socket or the plug is not inserted into the socket, the baffle plate is automatically reset and stretches out from the sliding groove under the force of the elastic reset mechanism. Thus, the opening is closed and the external dust can be prevented from entering into the socket body, achieving an ideal dustproof effect. Moreover, a stop block having a retractable structure is additionally disposed on the outer end surface of the baffle plate. When the baffle plate retracts into the sliding groove and the plug is inserted into the socket body, the baffle plate returns to the stretching position, and the plug is clamped at the notch of the outer end of the baffle plate. At this point, the stop block stretches outwards and abuts against the plug under the action of the elastic reset device, and the plug is surrounded by the stop block and the notch. Accordingly, the notch is closed, and the plug is clamped and fixed in the socket, effectively preventing the dust from entering into the socket. The dustproof socket capable of stabilizing a plug of the present invention can prevent the dust from entering into the socket while protecting the plug from being suddenly separated from the socket.

BRIEF DESCRIPTION OF THE DRAWINGS

To clearly expound the technical solution of the present invention, the drawings and embodiments are hereinafter combined to illustrate the present invention. Obviously, the drawings are merely some embodiments of the present invention and those skilled in the art can associate themselves with other drawings without paying creative labor.

MARKING INSTRUCTIONS OF THE DRAWINGS

1 Socket Body, 2 Mounting Cover, 3 Opening, 4 Slide Groove, 5 Baffle Plate, 6 Mounting Groove, 7 Stop Block, 8 Reset Rod, 9 Movable Block, 10 Connecting Shaft, 11 Elastic Element, 12 Fixing Groove, 13 Fixing Rod, 14 Elastic Body, 15 Connecting Cap, 16 Connecting Groove, 17 Baffle Ring, 18 Operating Rod, 19 Slide Opening, 20 Accommodating Groove, 21 Movable Plate, 22 Limiting Block, 23 Operating Cap

DETAILED DESCRIPTION OF THE INVENTION

Drawings and detailed embodiments are combined hereinafter to elaborate the technical principles of the present invention.

Figure 1:
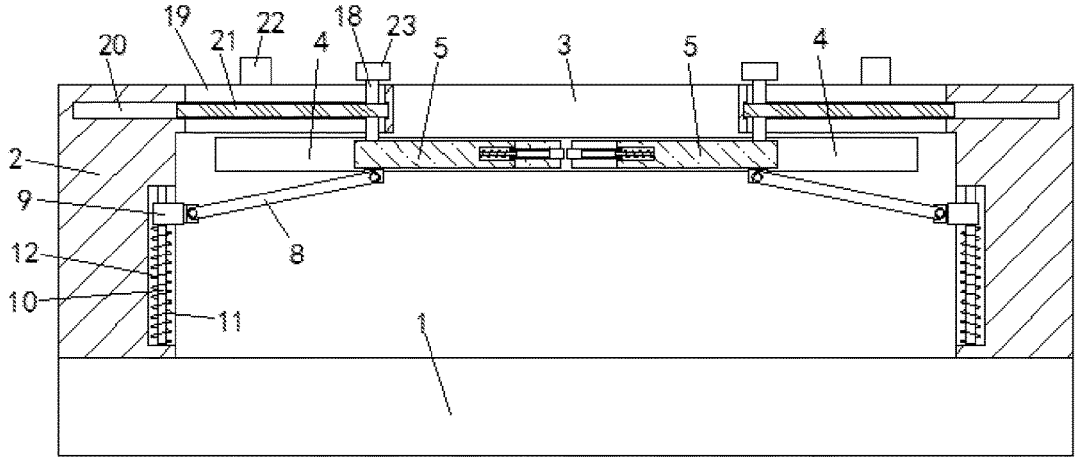
FIG. 1 is a structural diagram of the present invention.

As shown in FIG. 1, a dustproof socket capable of stabilizing a plug of the present invention comprises a socket body 1, wherein a mounting cover 2 is fixed on the socket body 1, and an opening 3 is formed in the mounting cover 2. The two ends of the inner side of the opening 3 are respectively provided with a sliding groove 4, and a baffle plate 5 is slidably mounted in each sliding groove 4. When the baffle plate 5 retracts into the sliding groove 4, the opening 3 is opened, and when the baffle plate 5 stretches out from the sliding groove 4, the opening 3 is closed. An elastic reset mechanism is connected between the baffle plate 5 and the mounting cover 2. The elastic reset mechanism is used for forcing the baffle plate 5 to keep in a state of stretching out from the sliding groove 4. A notch is formed in the outer end surface of the baffle plate 5, a mounting groove 6 is formed in the notch, and a stop block 7 is slidably disposed in the mounting groove 6. An elastic reset device is connected between the stop block 7 and the inner bottom of the mounting groove 6, and the elastic reset device is used for forcing the stop block 7 to keep in a state of stretching out from the mounting groove 6.

The opening 3 is formed in the mounting cover 2 of the socket body 1, and the plug can be inserted into the socket body 1 through the opening 3. Due to the existence of the opening 3, dust can easily enter the interior of the socket body 1, causing damage to the internal structure and the electric components of the socket body 1. Therefore, a baffle plate 5 having a retractable structure is additionally disposed at the opening 3 of the mounting cover 2. When the baffle plate 5 retracts into the sliding groove 4, the opening 3 is opened for allowing the plug to enter, and when the plug is completely inserted into the socket or the plug is not inserted into the socket, the baffle plate 5 is automatically reset and stretches out from the sliding groove 4 under the force of the elastic reset mechanism. Thus, the opening 3 is closed and the external dust can be prevented from entering the interior of the socket body 1, achieving an ideal dustproof effect. Moreover, a stop block 7 having a retractable structure is additionally disposed on the outer end surface of the baffle plate 5. When the baffle plate 5 retracts into the sliding groove 4 and the plug is inserted into the socket body 1, the baffle plate 5 returns to the stretching position, and the plug is just clamped at the notch of the outer end of the baffle plate 5. At the moment, the stop block 7 stretches outwards and abuts against the plug under the action of the elastic reset device, and the plug is surrounded by the stop block 7 and the notch. In such a way, the notch is closed, and the plug is clamped and fixed in the socket, effectively preventing the dust from entering into the socket.

FIG. 1 shows an embodiment of the dustproof socket of the present invention. In this embodiment, the socket comprises a socket body 1, and a mounting cover 2 is fixed on the socket body 1. An opening 3 is formed in the upper end of the mounting cover 2 for allowing the plug to insert into the socket. The lower portion of the opening 3 is located on the mounting cover 2. Two sliding grooves 4 are respectively disposed on the two sides of the opening 3, and the two sliding grooves 4 on the two sides are symmetrically arranged. Two baffle plates 5 are respectively disposed in each sliding groove 4, and the two baffles 5 in the two sliding grooves 4 are also symmetrically arranged. The baffle plate 5 can freely slide in the sliding groove 4 so that the baffle plate 5 is capable of retracting into the sliding groove 4 and stretching out from the sliding groove 4. When both of the two baffles 5 retract into the sliding grooves 4, the opening 3 in the mounting cover 2 is opened, and when both of the two baffles 5 stretch out from the sliding grooves 4, the two baffle plates 5 are connected to form an integral body to seal the opening 3.

An elastic reset mechanism is connected between the baffle plate 5 and the inner side surface of the mounting cover 2. The elastic reset mechanism is used for forcing the baffle plate 5 to keep in a state of stretching out from the sliding groove 4. Specifically, as shown in FIG. 1, the elastic reset mechanism comprises a reset rod 8, a movable block 9, a connecting shaft 10 and an elastic element 11. The inner surfaces of the two sides of the mounting cover 2 are respectively provided with a fixing groove 12. The connecting shaft 10 is fixed in the fixing groove 12, and the movable block 9 is slidably sleeved with the connecting shaft 10. The elastic element 11 that is sleeved on the connecting shaft 10 is connected to the bottom end of the movable block 9 and the fixing groove 12. The two ends of the reset rod 8 are respectively rotationally hinged to the baffle plate 5 and the movable block 9. The two ends of the reset rod 8 are in a shaft-pin fit with the baffle plate 5 and the movable block 9, and this allows the two ends of the reset rod 8 to freely rotate relative to the movable block 9 and the baffle plate 5. In such a configuration, a mounting base is additionally disposed on the movable block 9 and the baffle plate 5. A circular groove is formed in the mounting base, and a rotating pin is rotationally disposed in the circular groove. The two ends of the reset rod 8 are respectively provided with a circular groove, thereby enabling the reset rod 8 to be sleeved with the rotating pin. Thus, the two ends of the reset rod 8 can freely rotate. When the baffle 5 retracts into the sliding groove 4, the baffle plate 5 propels the movable block 9 to move downwards along the connecting shaft 10 through the reset rod 8. Meanwhile, the movable block 9 presses the elastic element 11, enabling the elastic element 11 to accumulate elastic potential energy. When the baffle plate 5 no longer bears the external force, the elastic part 11 releases the elastic potential energy to propel the movable block 9 to slide upwards along the connecting shaft 10. The movable block 9 propels the baffle plate 5 to slide through the reset rod 8, thus enabling the baffle plate 5 to stretch out from the sliding groove 4. As the elastic element 11 imposes an upward elastic force onto the movable block 9 all the time, the baffle plate 5 can be kept in a state of stretching out from the sliding groove under the action of the whole mechanism.

Figure 2:
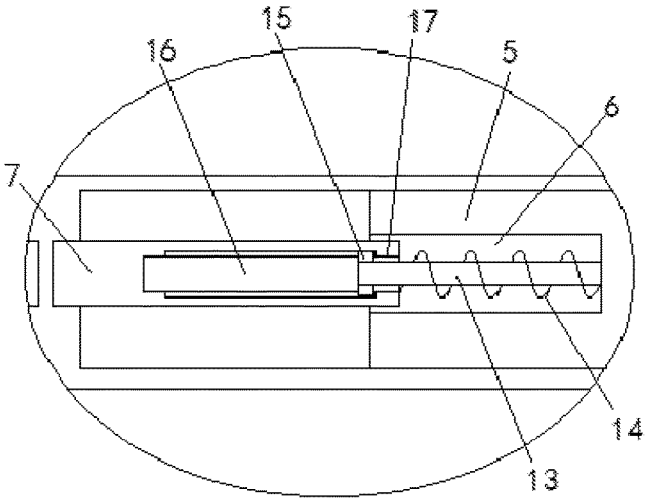
FIG. 2 is a schematic diagram illustrating the internal structure of the baffle plate of the present invention.

As shown in FIGS. 1-2, the end surfaces of the two baffle plates 5 that are opposite to each other are respectively provided with a notch, and the two notches are symmetrically arranged. When the two baffles 5 are located at the stretching position, the two symmetrical notches form an integral body for accommodating the plug. The two notches are respectively provided with a mounting groove 6, and the two mounting grooves 6 are symmetrically arranged. Two stop blocks 7 are respectively disposed in each mounting groove 6, and the two stop blocks are symmetrically arranged. The stop block 7 can slide in the mounting groove 6. When the two baffle plates 5 are located at the stretching position, and the stop block 7 retracts into the mounting groove 6, the notch in the baffle plate 5 is opened. On contrary, when two baffle plates 6 are located at the stretching position, and the stop block 7 stretches out from the mounting groove 6, the notch in the baffle plate 5 is closed.

An elastic reset device is connected between the stop block 7 and the bottom of the mounting groove 6. The elastic reset device is used for forcing the stop block 7 to keep in a state of stretching out from the mounting groove 6. Specifically, as shown in FIG. 2, the elastic reset device comprises a fixing rod 13 and an elastic body 14. One end of the fixing rod 13 is fixed at the bottom end of the mounting groove 6, and the other end of the fixing rod 13 is provided with a connecting cap 15. The stop block 7 is provided with a connecting groove 16, and a baffle ring 17 is disposed at the opening 3 of the connecting groove 16. The connecting cap 15 is slidably inserted into the connecting groove 16. The elastic body 14 is sleeved on the fixing rod, and is connected to the bottom of the stop block 7 and the mounting groove 6. When the stop block 7 slides in the mounting groove 6, the connecting cap 15 also slides in the connecting groove 6. As the connecting cap 15 is blocked by the baffle ring 17, the connecting cap 15 is always kept within the connecting groove 16. In such a way, the stop block 7 is protected from being separated from the fixing rod 13, and is always connected with the fixing rod 13. When the stop block 7 retracts into the mounting groove 6, the stop block 7 presses the elastic body 14, enabling to elastic body 14 to accumulate elastic potential energy. The connecting cap 15 on the fixing rod slides within the connecting groove 16, thus exerting limiting and guiding functions between the stop block 7 and the fixing rod 13. When the stop block 7 no longer bears the external force, the elastic body 14 releases the elastic potential energy to propel the stop bock 7 to extend out from the mounting groove 6. As the elastic body 14 always imposes an outward elastic force onto the stop block 7, the stop block 7 always possesses a tendency of stretching out from the mounting groove 6.

Figure 3:
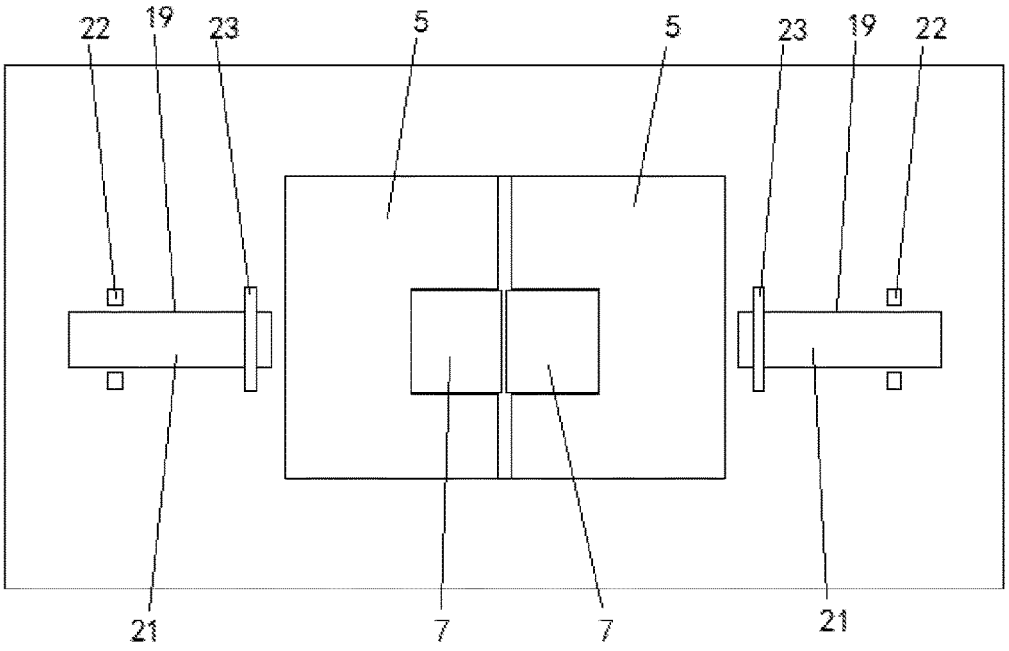
FIG. 3 is a front view of the present invention.

As shown in FIGS. 1-3, an operating rod 18 is connected to the baffle plate 5, and a slide opening 19 is formed in the outer surface of the mounting cover 2. The operating rod 18 is slidably located in the slide opening 19. Through the operating rod 18, the baffle plate 5 can be conveniently operated. For instance, when stirring the operating rod 18 left and right, the baffle plate 5 is enabled to stretch out from or retract into the slide groove 4. As shown in FIG. 1, an accommodating groove 20 is formed in the mounting cover 2 and is close to the slide opening 19. The accommodating groove 20 and the slide groove 4 are arranged in parallel. A movable plate 21 is slidably disposed in the accommodating groove 20, and one side of the movable plate 21 is connected to the operating rod 18. When the movable plate 21 is aligned with the slide opening 19, the slide opening 19 is sealed. When stirring the operating rod 18, the baffle plate 5 and the movable plate 21 synchronously move along the operating rod 18. The baffle plate 5 moves in the slide opening 4, and the movable plate 21 moves in the accommodating groove 20. As shown in FIG. 3, a limiting block 22 is disposed on the outer surface of the mounting cover 2, and an operating cap 23 is rotationally connected with the end portion of the operating rod 18. The operating cap 23 possesses a first position and a second position during the rotating process. Specifically, there're two limiting blocks 22 that are arranged in parallel. When the operating cap 23 is in the first position, the operating cap 23 is prevented from passing through a gap between the two limiting blocks 22. Thus, the operating cap is limited by the limiting blocks 22. When the operating cap 23 is in the second position, it is allowed to pass the gap between the two limiting blocks 22. As shown in FIG. 3, the operating cap 23 is a cuboid structure. From the viewing angle of FIG. 3, when the operating cap 23 is rotated, the long edge of the operating cap 23 is kept transverse. At the moment, the operating cap 23 can be stirred to pass through the gap between the two limiting blocks 22. Subsequently, the operating cap 23 is re-rotated, enabling its long edge to be kept vertical. The operating cap 23 is blocked by the limiting blocks 22 after being released. Accordingly, the operating rod 18 can be kept at the position where the limiting block 22 is located. When the operating rod 18 is required to return to its initial position, the operating cap 23 can be rotated, enabling its long edge to be kept transverse. Thus, the operating cap 23 passes through the gap between the two limiting blocks 22 in the reverse direction. Subsequently, the operating cap 23 is re-rotated so that its long edge is kept vertical. After being released, the operating cap 23 returns to the initial position.

During the use of the dustproof socket of the present invention, a series of operations need to first be performed by a user. First, the operating cap 23 needs to be stirred to two outer sides for enabling the operating rod 18 to propel the movable plate 21 and the baffle plate 5 to move to the two sides. When the operating cap 23 is close to the limiting block 22, the operating cap 23 is rotated to a second position. Thus, the operation cap 23 is enabled to pass through the limiting block 22. Subsequently, the operating cap 23 is rotated to the first position. After being released, the operating cap 23 is limited at the position where the limiting block 22 is located, and the operating rod 18 is kept at the position where the limiting block 22 is located. When the baffle plate 5 moves along with the operating rod 18, the baffle plate 5 slides towards the interior of the slide groove 4, and the opening 3 is opened. When the operating rod 18 is fixed at the position where the limiting block 22 is located, the baffle plate 5 is kept in a contracting state, and the opening 3 is opened. Meanwhile, the elastic reset mechanism that is connected between the baffle plate 5 and the mounting cover 2 accumulates elastic potential energy. Through the interaction between the operating cap 23 and the limiting block 22, the opening 3 in the mounting cover 2 is always opened, allowing a user to conveniently perform the following operations without holding the operating rod 18 all the time. After the opening 3 is opened, the plug can be easily inserted into the socket body 1.

When the plug is completely inserted into the socket body 1, the operating cap 23 is rotated to the second position, and the operating cap 23 is enabled to pass through the limiting block 22. Subsequently, the operating cap 23 is re-rotated to the first position and then the operating cap 23 is released. Under the action of the elastic potential energy of the elastic reset mechanism, the baffle plate 5 is kept in a state of stretching out from the slide groove 4. During the sliding process, the baffle plate 5 propels the operating rod 18 to reset. After completely stretching out from the slide groove 4, the baffle plates 5 are closed so that the opening 3 can be sealed, preventing the dust from entering into the socket body 1 through the opening 3. At the moment, the stop block 7 on the baffle plate 5 abuts against the plug. The elastic reset device imposes an elastic force onto the stop blocks 7, enabling the stop blocks 7 to tightly clamp the plug. In this way, the plug is clamped in the notch of the baffle plates and is fixed therein, achieving an ideal fixing effect. Furthermore, the periphery of the plug is surrounded by the stop block 7 and the notch for preventing the dust from entering the socket body 1. When the baffle plate 5 propels the operating rod 18 to reset, the movable plate 21 and the operating rod 18 are connected into a whole body. Thus, the movable plate 21 can reset along with the operating rod 18. After the movable plate 21 is reset, the slide opening 19 can be closed so that the dust can be prevented from entering into the socket body 1 from the slide opening 19. When there's a need to remove the plug from the socket body 1, the above operating process can be reversely performed. The opening 3 in the mounting cover 2 can be opened through adjusting the operating rod 18, and after the plug is removed from the socket, the opening 3 can be closed through re-adjusting the operating rod 18.

Through the elastic force imposed on the baffle plate 5 by the elastic reset mechanism, and the elastic force imposed on the stop block 7 by the elastic reset device, the baffle plate 5 interacts with the stop block 7 to seal the opening 3 in the mounting cover 2, and to provide a clamping force to the plug. Thus, the dust can be prevented from entering into the socket body 1, and the plug can be fixed in the socket. Meanwhile, the plug can be conveniently inserted into or removed from the socket body 1. The dustproof socket of the present invention achieves an ideal dustproof performance while preventing the dust from entering into the socket. Moreover, the plug inserted into the socket can be stabilized by the dustproof socket of the present invention, effectively preventing the plug from being separated from the socket.

The description of above embodiments allows those skilled in the art to realize or use the present invention. Without departing from the spirit and essence of the present invention, those skilled in the art can combine, change or modify correspondingly according to the present invention. Therefore, the protective range of the present invention should not be limited to the embodiments above but conform to the widest protective range which is consistent with the principles and innovative characteristics of the present invention. Although some special terms are used in the description of the present invention, the scope of the invention should not necessarily be limited by this description. The scope of the present invention is defined by the claims.

The invention claimed is:

1. A dustproof socket capable of stabilizing a plug, comprising:

a socket body, wherein a mounting cover is fixed on the socket body, and an opening is formed in the mounting cover, wherein the two ends of the inner side of the opening are respectively provided with a sliding groove, and a baffle plate is slidably mounted in each sliding groove, wherein when the baffle plate retracts into the sliding groove, the opening is opened, and when the baffle plate stretches out from the sliding groove, the opening is closed, wherein an elastic reset mechanism is connected between the baffle plate and the mounting cover, wherein the elastic reset mechanism is used for forcing the baffle plate to keep in a state of stretching out of the sliding groove, wherein a notch is formed in the outer end surface of the baffle plate, a mounting groove is formed in the notch, and a stop block is slidably disposed in the mounting groove, wherein an elastic reset device is connected between the stop block and the inner bottom of the mounting groove, and the elastic reset device is used for forcing the stop block to keep in a state of stretching out of the mounting groove.

2. The dustproof socket capable of stabilizing a plug of claim 1, wherein the elastic reset mechanism comprises a reset rod, a movable block, a connecting shaft and an elastic element, wherein the inner surfaces of the two sides of the mounting cover are respectively provided with a fixing groove, wherein the connecting shaft is fixed in the fixing groove, and the movable block is slidably sleeved with the connecting shaft, wherein the elastic element that is sleeved on the connecting shaft is connected to the bottom end of the movable block and the fixing groove, wherein the two ends of the reset rod are respectively rotationally hinged to the baffle plate and the movable block.

3. The dustproof socket capable of stabilizing a plug of claim 1, wherein the elastic reset device comprises a fixing rod and an elastic body, wherein one end of the fixing rod is fixed at the bottom end of the mounting groove, and the other end of the fixing rod is provided with a connecting cap, wherein the stop block is provided with a connecting groove, and a baffle ring is disposed at the opening of the connecting groove, wherein the connecting cap is slidably inserted into the connecting groove, wherein the elastic body is sleeved on the fixing rod, and is connected to the bottom of the stop block and the mounting groove.

4. The dustproof socket capable of stabilizing a plug of claim 1, wherein an operating rod is connected to the baffle plate, and a slide opening is formed in the outer surface of the mounting cover, wherein the operating rod is slidably located in the slide opening.

5. The dustproof socket capable of stabilizing a plug of claim 4, wherein an accommodating groove is formed in the mounting cover, and is close to the slide opening, wherein the accommodating groove and the slide groove are arranged in parallel, wherein a movable plate is slidably disposed in the accommodating groove, and one side of the movable plate is connected to the operating rod, wherein when the movable plate is aligned with the slide opening, the slide opening is sealed.

6. The dustproof socket capable of stabilizing a plug of claim 4, wherein a limiting block is disposed on the outer surface of the mounting cover, and an operating cap is rotationally connected with the end portion of the operating rod, wherein the operating cap possesses a first position and a second position during the rotating process, wherein when the operating cap is in the first position, it can be limited by the limiting blocks, and when the operating cap is in the second position, it is allowed to pass the gap between the limiting blocks.

7. The dustproof socket capable of stabilizing a plug of claim 6, wherein there're two limiting blocks that are arranged in parallel, wherein when the operating cap is in the first position, the operating cap is prevented from passing through a gap between the two limiting blocks, wherein when the operating cap is in the second position, it can pass the gap between the two limiting blocks.

* * * * *